US005211366A

United States Patent [19]

Cummings

[11] Patent Number: 5,211,366

[45] Date of Patent: May 18, 1993

[54] ORNAMENTAL SUPPORT FOR CHRISTMAS TREE AND THE LIKE

[76] Inventor: John W. Cummings, 2111 Peachtree La., San Jose, Calif. 95128

[21] Appl. No.: 823,035

[22] Filed: Jan. 13, 1992

Related U.S. Application Data

[63] Continuation of Ser. No. 637,103, Jan. 3, 1991, abandoned.

[51] Int. Cl.[5] ..... A47B 96/06

[52] U.S. Cl. ..... 248/237; 238/10 R; 104/56

[58] Field of Search ..... 248/231, 230, 523; 211/205, 196; 47/43, 40.5; 238/10 A, 10 E, 10 R, 10 F; 104/56, 53

[56] References Cited

U.S. PATENT DOCUMENTS

| | | | |
|---|---|---|---|
| 14,742 | 10/1919 | Behr, Jr. | 238/10 E |
| 882,850 | 3/1908 | Troell | 248/231 X |
| 906,732 | 12/1908 | McDonagh et al. | 104/56 |
| 962,185 | 6/1910 | White | 211/196 X |
| 1,034,137 | 7/1912 | Müller | 104/56 |
| 1,342,626 | 6/1920 | Frank | 248/231 X |
| 1,654,427 | 12/1927 | Modlarz | 211/196 |
| 1,893,585 | 1/1933 | Hogan | 248/231 X |
| 2,190,544 | 2/1940 | Jarnagin . | |
| 2,874,496 | 2/1959 | Rakes . | |
| 2,956,357 | 10/1960 | Rakes . | |
| 3,143,324 | 8/1964 | Kappelman | 248/523 X |
| 3,424,317 | 1/1969 | Singer | 211/196 X |
| 3,438,145 | 4/1969 | Genin | 238/10 F |
| 3,692,617 | 9/1972 | Marks et al. | 211/205 X |
| 4,332,378 | 1/1982 | Pryor | 211/205 X |
| 4,585,166 | 4/1986 | Stephens | 238/10 R |
| 4,623,195 | 11/1986 | Avella | 248/230 X |
| 4,746,022 | 5/1988 | Benham | 211/196 X |
| 4,877,140 | 10/1989 | Lee | 211/205 X |

FOREIGN PATENT DOCUMENTS

| | | | |
|---|---|---|---|
| 3609357 | 10/1987 | Fed. Rep. of Germany | 248/523 |
| 0063988 | 7/1949 | Netherlands | 248/231 |

*Primary Examiner*—Alvin C. Chin-Shue
*Assistant Examiner*—Korie H. Chan
*Attorney, Agent, or Firm*—Townsend and Townsend Khourie and Crew

[57] ABSTRACT

An improved, ornamental, decorative structure such as a Christmas tree or the like in which the structure has a decorative device mounted above a floor in cantilever fashion. Thus, the decorative device, is, in effect, cantilevered above the floor and uses a center portion of the structure as the main support, thus avoiding the need for additional support beneath the device and on a floor therebelow. The device itself can be a ring which can support another object, such as a continuous track over which a train can be movable, either under manual power or by electrical power supplied to the track by an electrical transformer on the floor adjacent to the ornamental structure. The train will have an engine provided with an electrical motor which will drive the train along at an elevated position. Thus, the device will provide a display which will provide enjoyment and amusement for young and old alike. The operation of the train and other still or moving parts associated with the elevated device will be seen from a location near the structures and will present no hazards which might otherwise detract from the aesthetic and safety aspects of the device as well as the ease with which the elements mount the device on a center portion of the Christmas tree or the like.

11 Claims, 2 Drawing Sheets

ORNAMENTAL SUPPORT FOR CHRISTMAS TREE AND THE LIKE

This is a continuation of application Ser. No. 07/637,103, filed Jan. 3, 1991, now abandoned.

This invention relates to improvements for decorative, ornamental structures and, more particularly, to an ornamental support for use with an upright object, such as a Christmas tree and the like.

BACKGROUND OF THE INVENTION

A toy train is sometimes used at the base of a Christmas tree to provide a decorative effect to the tree, and such toy trains typically are mounted and supported on the floor around the trunk of the tree. The toy train can be coupled to and movable along a continuous track on the floor. Thus, persons observing the train while stopped or in operation will derive a certain amount of enjoyment and will be pleasantly amused to observe the train. This adds to the festive atmosphere generated by the holiday season and the presence of the Christmas tree.

Typical disclosures showing a toy train at the base of a Christmas tree and supported on an adjacent floor include U.S. Pat. Nos. 2,874,496 and 2,956,357. U.S. Pat. No. 2,190,544 shows a Christmas tree base ornament around which a train and track are used but the track is supported from beneath on a floor rather than being in an elevated position above a floor.

SUMMARY OF THE INVENTION

The present invention is directed to an improved, ornamental decorative structure, such as a Christmas tree or the like, in which the structure has a decorative device mounted above a floor in cantilever fashion. Thus, the decorative device, is, in effect, cantilevered above the floor and uses a center portion of the ornamental, decorative structure as the main support, thus avoiding the need for additional support beneath the device and on a floor therebelow as in the patents mentioned. The device itself can be a ring which can support another object, such as a continuous track over which a train can be movable, either under manual power or by electrical power supplied to the track by an electrical transformer on the floor adjacent to the ornamental structure. The train of the device will have an engine provided with an electrical motor which will drive the train along the track at an elevated position. Thus, the device will provide a display which will provide enjoyment and amusement for young and old alike. The operation of the train and other still or moving parts associated with the elevated device will be seen from a location near the structures and will present no hazards which might otherwise detract from the aesthetic and safety aspects of the device as well as the ease with which the elements mount the device on a center portion of the structure or the trunk of the Christmas tree.

The primary object of the present invention is to provide a decorative, ornamental device which can be mounted in an elevated position on a central element or trunk, such as the trunk of a Christmas tree or the like, whereby the device is cantilevered so as to provide a support or base for a moving or still object, such as a toy train, to stimulate the interest of observers adjacent to the tree and to thereby generate enjoyment and amusement on the part of such observers yet the device can be mounted and disassembled with a minimum of skill on the part of the user.

Other objects of this invention will become apparent as the following specification progresses, reference being had to the accompanying drawings for an illustration of the invention.

DETAILED DESCRIPTION OF THE EMBODIMENT

Figure 1:
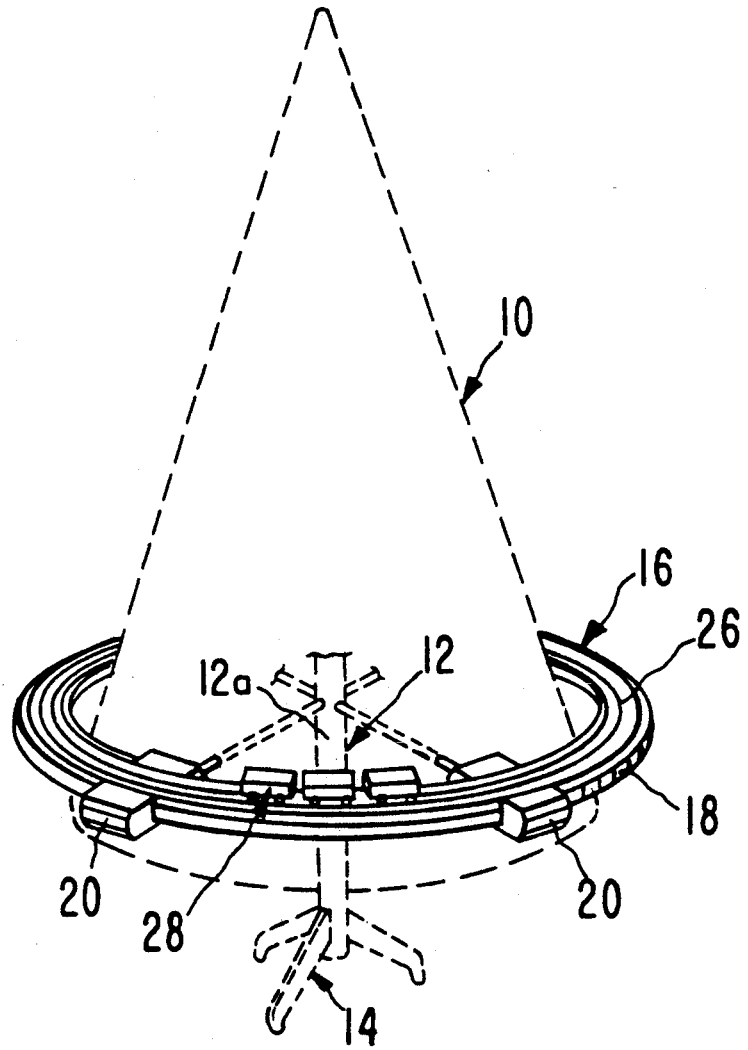
FIG. 1 is a perspective view of a Christmas tree showing the mounting means of the present invention coupled thereto.

The apparatus of the present invention, for purpose of illustration, is described as a tree 10 having a trunk 12 provided with a floor support 14 for mounting the trunk 12 and tree 10 in a generally upright position on a floor beneath the tree. A display device 16 and its mounting means 17 for device 16 on trunk 12 comprise elements of the present invention. Display 16 is above the floor when the tree is mounted by support 14 on the floor.

Figure 2:
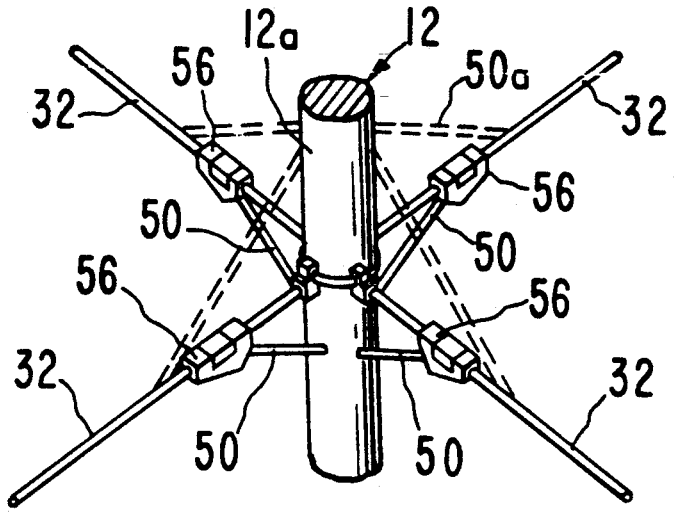
FIG. 2 is an enlarged, fragmentary cross-sectional view of the mounting means showing the elements thereof in greater detail.

The tree 10 is a conventional tree, such as a Christmas tree or the like. Its trunk 12 extends to the top of the tree and includes a slightly bare space or surface portion 12*a*, as shown in FIGS. 1 and 2, to which the mounting means 17 is coupled.

Display 16 can be of any suitable construction but, for purposes of illustration, it is an annular ring 18 which has mounting means 17 for coupled the ring to the trunk portion 12*a* with the ring spaced above the floor on which support 14 rests.

Ring 18 can be formed in any suitable manner. For purposes of illustration, the ring is formed from 4 curved segments denoted by the numerals 18*a*, 18*b*, 18*c* and 18*d*. These segments are interconnected at their ends to adjacent segments by way of connecting members 20 which are four in number and which have circumferential grooves 22 for snugly receiving the ends of adjacent segments 18*a*, 18*b*, 18*c* and 18*d*. Each of the segments has a groove 24 for receiving a track 26 over which a toy train 28 can move.

Toy train 28 is made up of a number of car elements 30 which are interconnected and which can move under the influence of electrical power supplied to the engine of the train by way of a transformer coupled by wires (not shown) to the track 26 in the usual manner for electric toy trains.

Figure 3:
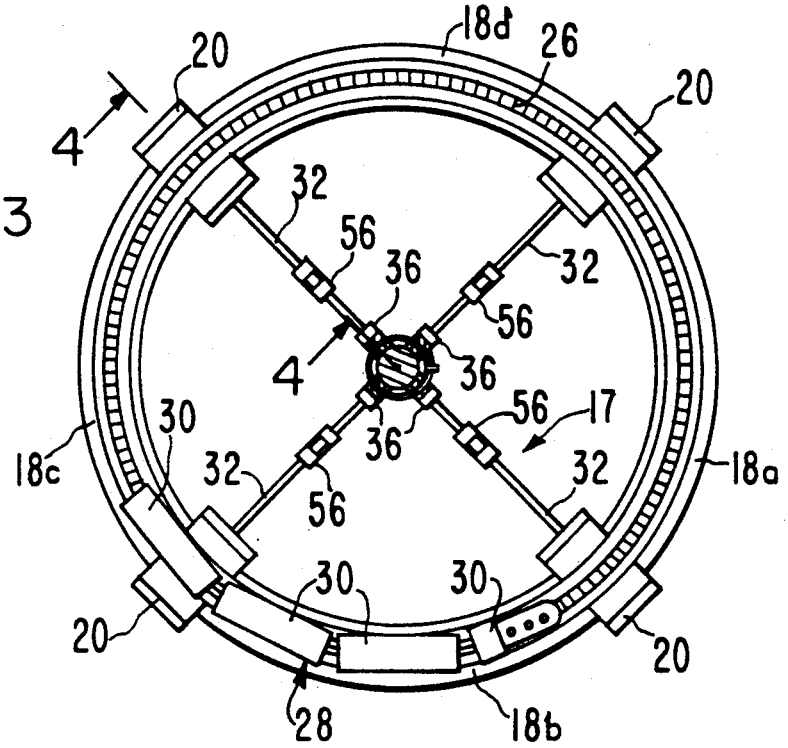
FIG. 3 is a horizontal section through the Christmas tree showing the way in which the mounting means is coupled to the trunk of the tree.
Figure 4:
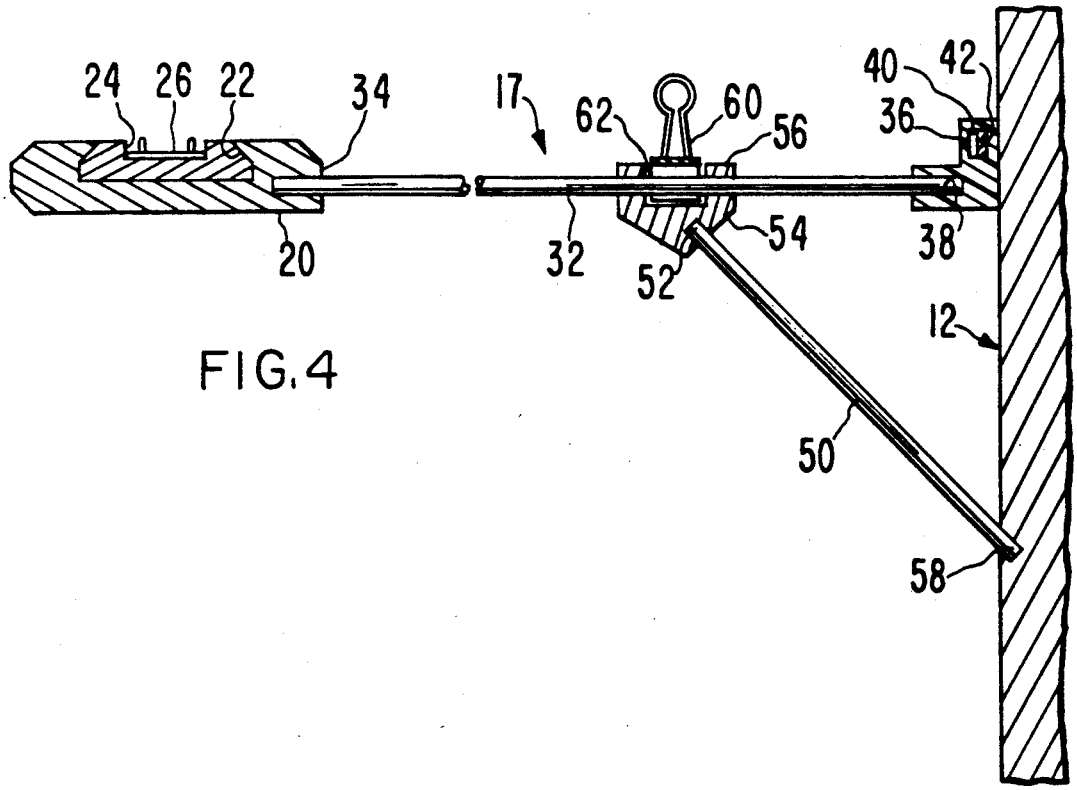
FIG. 4 is an enlarged cross-sectional view taken along line 4—4 of FIG. 3.

Four radial rods 32 extend radially inwardly from flat end faces 34 of members 20 as shown in FIG. 4. Rods 32 are coupled at their inner ends to block members 36 which bear against trunk 12 and have holes 38 for receiving the inner end of the respective rods 32. The four bearing blocks 36 are all provided with slots 40 therethrough for receiving a flexible plastic tie wrap 42 which passes through holes 40 and anchor blocks 36 to the trunk 12 as shown in FIG. 4. The blocks are at 90. locations with respect to each other as shown in FIG. 3 and rods 32 are substantially radial.

There may be a need for four braces 50 which are angled as shown in FIG. 4 with respect to trunk 12. Braces 50 are rods each of which has an upper end 52 received within a hole in an inclined face 54 of a slidable element 56 on the adjacent rod 32. The lower end 58 of rod 50 bears against a lower part of the trunk 12 as shown in FIG. 4 so as to support rod 32 from beneath. Suitable means, such as a conventional clip 60 or built in release, extends into a notch 62 of element 56 and surrounds rod 32 in the notch. Clip 60, therefore causes the element 56 to be releasably coupled to the rod 32 so that brace 50 is stabilized when its lower end engages the trunk of the tree 12 as shown in FIG. 4.

A flexible cord, shown in dashed lines in FIG. 2, could be used above each of the braces 50, respectively, in place of the braces 50.

In use, tree 10 is provided with support 14 on the lower end of the trunk 12 and the tree is mounted on a floor in an upright position as shown in FIG. 1. Display 16 can be mounted by rods 32 and the other means shown in FIG. 4 on trunk 12 so as to support the train 28 on ring 16. The train may be on the display ring 18 merely for display purposes; however, a transformer can be coupled to the track of a train and a train can be caused to move if the train has an engine which is electrically driven by the voltage supplied by the transformer to the track.

The train can move around the track 26 about the tree 10 with the track spaced well above the floor. This allows packaged gifts and other objects to be placed on the floor adjacent to the tree yet the display, i.e., the movable train can be viewed at an elevated position above the floor by virtue of the ring position much to the delight and amusement of observers spaced from the tree.

While a tree 10 has been shown as being the structure on which ring 18 is mounted, the tree could be replaced with other structure, if desired.

What is claimed is:

1. Apparatus for providing a decorative, ornamental appearance comprising:

an upright tree having branches and pair of opposed ends forming a trunk, and mounting means adapted to rigidly mount the trunk in an upright fixed position extending above a floor;

a ring-like device surrounding the trunk with the device being at a position spaced above the floor, said device having an upper support surface, a movable wheeled toy unit supported on and movable in rolling and driving relationship to said support surface and about said trunk; and a plurality of elongated means each having an outer end coupled with the ring-like device and an inner end attached to the central support adapted to rigidly mount the ring-like device in a fixed cantilever position relative to the support trunk, at least a part of said upper support surface extending outwardly beyond an outermost extent of adjacent branches of the tree.

2. Apparatus as set forth in claim 1, wherein said mounting means includes a number of radial rods extending from the ring-like device to the trunk, first means at the outer ends of the rods for securing the rods to the ring-like device, and said means near the inner ends of the rods for mounting the rods to the trunk.

3. Apparatus as set forth in claim 2, wherein said first means includes a number of outer blocks, each outer block having a radial rod, each block having an inner face provided with a hole therethrough for receiving the outer end of the respective radial rod, said second means including a number of inner blocks engaging the outer surface of the trunk, each inner block having a hole for receiving the inner end of the corresponding radial rod, and means for coupling the inner blocks to the trunk at circumferential locations thereon.

4. Apparatus as set forth in claim 3, wherein each in block has a circumferentially extending slot therethrough, there being a tie means passing through the slots of the inner blocks for securing the inner blocks to the central support at fixed locations thereon.

5. Apparatus as set forth in claim 1, wherein is included a brace for each radial rod, respectively, each brace extending between the trunk and a location intermediate the ends of the respective rod.

6. Apparatus as set forth in claim 5, wherein the braces are above the adjacent radial rod.

7. Apparatus as set forth in claim 5, wherein each brace is below the corresponding radial rod.

8. Apparatus as set forth in claim 5, wherein each brace is at an acute angle with respect to the corresponding radial rod, the inner end of the brace bearing against the trunk, and means coupling the outer end of the brace to the corresponding radial rod.

9. Apparatus as set forth in claim 8, wherein said coupling means is a block having a hole for receiving the outer end of the brace, and clip means for securing the block to the respective radial rod intermediate the ends thereof.

10. Apparatus as set forth in claim 1, wherein said wheeled toy unit is a toy train.

11. Apparatus for providing a decorative, ornamental appearance comprising:

an upright structure having a central support and means for mounting the central support in an upright fixed position above a floor;

a device having a continuous inner periphery surrounding the central support with the device being at a position spaced above the floor, said device having an upper support surface surrounding and spaced outwardly from the central support for supporting a movable object for movement about said central support, said device includes a ring formed from a number of segments, said ring having a connecting member between and coupled to adjacent pairs of segments, respectively, each connecting member having grooves for receiving the ends of adjacent segments, each segment having a groove for forming a track over which a toy train can move; and means coupled with the inner periphery of the device and to the central support for mounting the device in a cantilever manner on the support.

* * * * *